United States Patent [19]

Benedet

[11] Patent Number: 4,699,245

[45] Date of Patent: Oct. 13, 1987

[54] SAFETY DEVICE FOR WORKING AT GREAT HEIGHTS

[75] Inventor: René Benedet, Le Bourg Par Buxy, France

[73] Assignee: Ets Alfred Herlicq & Fils, Montrouge, France

[21] Appl. No.: 893,135

[22] Filed: Aug. 5, 1986

[30] Foreign Application Priority Data

Jun. 27, 1986 [FR] France ..... 86 09398

[51] Int. Cl.[4] ..... E04G 21/32

[52] U.S. Cl. ..... 182/3; 182/36

[58] Field of Search ..... 182/3–7, 182/36

[56] References Cited

U.S. PATENT DOCUMENTS

| | | | |
|---|---|---|---|
| 3,193,050 | 7/1965 | Galante | 182/3 |
| 4,037,824 | 7/1977 | Whitmer | 256/53 |
| 4,313,236 | 2/1982 | Tupper | 182/3 |

FOREIGN PATENT DOCUMENTS

| | | | |
|---|---|---|---|
| 3023489 | 6/1980 | Fed. Rep. of Germany | 182/3 |
| 1356533 | 4/1963 | France . | |
| 1178885 | 3/1984 | U.S.S.R. | 182/3 |
| 1178886 | 3/1984 | U.S.S.R. | 182/3 |

*Primary Examiner*—Reinaldo P. Machado

*Attorney, Agent, or Firm*—Pollock, Vande Sande & Priddy

[57] ABSTRACT

Safety device for working at great heights, comprising a cable (2) stretched parallel to a direction of movement and carried by spaced supports (4), and a hooking element (33) sliding along the cable. Each support consists of a substantially horizontal axle fixed at one end on a fixed part (41) and carrying at its other end a plate (5) holding the cable (2). The plate is mounted for rotation on the axle (40) and has two opposite notches (51) in which the hooking element engages by sliding on the cable (2) in order to pass above the support axle (40) through rotation of the holding plate (5), the latter being automatically returned to a rest position in which the two notches (51) are aligned with the cable (2), each in one direction.

15 Claims, 12 Drawing Figures

SAFETY DEVICE FOR WORKING AT GREAT HEIGHTS

FIELD OF THE INVENTION

The invention relates to a device for securing the safety of a person moving at a great height.

BACKGROUND OF THE INVENTION

In certain cases, for example on board ships, on civil engineering worksites, such as bridges, dams, and the like, or on the running tracks of traveling cranes, personnel may be required to move over a path situated at a great height which, on at least one side, cannot be provided with a railing. Personnel must then wear a safety harness consisting of a belt adapted to be hooked to a cable or other elongated element fixed along the path of movement.

The device described in French Patent No. 1,356,533, for example, consists of a cable fixed at both ends and stretched parallel to the movement path. An element hooking to the safety harness can slide along this cable. If the cable is not very long, the hooking element can slide from one end to the other. However, it is generally necessary for the cable to be carried by regularly spaced support elements. A system must then be be provided which enables the sliding hooking element to pass over each support without having to be unhooked. For this purpose the patent discloses a particular support element provided with a spiral slot enabling the support element to pass without being unhooked, while still supporting the cable. However, a system of this kind requires relatively complicated machining and makes it necessary for the person secured to pay particular attention to the passage of the hooking element over the supports.

SUMMARY OF THE INVENTION

The invention relates to a simpler and less expensive safety device, which in addition makes it possible for the hooking element used to be a simple snap hook which in case of need can be fastened at any point on the cable.

Furthermore, the invention does not merely apply to movement along a specified path, but can, in a preferred embodiment, be adapted to movement on a structure of large size, for example a roof, thereby providing the person secured with greater freedom of movement.

According to the invention, each cable support element consists of a substantially horizontal axle lying at right angles to the cable and fixed at one end, on the side remote from the movement path, on a fixed part, while at its other end, on the movement path side, it carries a cable holding plate at right angles to the axle and mounted for rotation on the latter, the cable being simply laid on each support axle and retained on one side by the fixed part and on the other side by the holding plate, the latter being provided with two diametrically opposite notches for the passage of the hooking element in one direction of the other, each notch being open towards the outside and having a sufficient width for the hooking element to be able to engage in it by sliding on the cable and to pass above the support axle through the rotation of the holding plate, the latter being associated with a means returning it to a position of rest in which the two notches are in line with the cable, each in one direction.

Each support axle is preferably associated with a fixed downwardly facing yoke adapted to extend over the holding plate and to close the notch when the latter moves into the vertical position. The closing yoke is advantageously in the form of a U-shaped member centered in the vertical plane of symmetry through the axle and having a width greater than that of the notches and a height less than the length of the notches, its bottom being placed at a distance from the axle slightly greater than the distance of the outer edge of the notches from the axle.

According to another advantageous characteristic, the means returning the plate to the position of rest comprises the eccentric arrangement of the center of gravity of the plate along the axis of symmetry passing between the two notches.

In a preferred embodiment of the invention, adapted for movement on a structure of large size, the person secured is connected to the hooking element by means of a tether which is of sufficient length to give with a certain freedom to travel in every direction on the structure, and the hooking element consists of an elongated bush, provided with an internal bore of a diameter substantially equal to that of the safety cable and capable of sliding with light friction on the cable under the action of a tractive force exerted at a distance on the tether by the person secured.

The elongated bush is preferably mounted permanently on the cable and the tether is hooked on the bush by means of an attaching element which is removable in the manner of a snap hook or a shackle.

The elongated bush is advantageously provided with shaped portions at its two ends which enable it to be introduced into the notches of the holding plate without risk of blockage.

When the device according to the invention is applied to movement on a roof, the safety cable is stretched between two fixed points, preferably parallel to the roof, and in a horizontal direction.

It has, however, been found that the device according to the invention could also be used to secure the safety of a person moving on a metal trellis structure such as a pylon or scaffolding, the safety cable in this case being stretched in a preferred direction of movement along the structure.

Furthermore, it is sometimes necessary to give the safety cable a more or less sinuous path, for example in order to cover the different faces of a roof or in order to travel in different directions on a pylon. According to a further advantageous improvement of the invention, the safety cable passes over the intermediate support elements determining a change of direction and each comprising two holding plates set at a distance from each other, at least one of which is mounted rotatably about a transverse axis and a series of rollers placed between the said plates and arranged in a circular line around the axis of rotation, the safety cable coiling around an angular section of the circular line by bearing on the corresponding rollers, and the rotatable plate being provided with at least two notches the shape of which is determined so as to allow the hooking element to be introduced with rotation of the plate in one or another of the directions of travel on the cable, the said notches being arranged on the plate in such a way that a notch is positioned on the passage of the hooking element in each direction of travel and that the said notch is replaced by another notch, after rotation of the necessary angle for the passage of the hooking element.

In the most usual circumstance, the holding plate is provided with two notches which are diametrically opposed, whose shapes are derived from one another by rotation of 180° and which have two sides oriented in such a manner that, in each zone in which the cable is tangential to the line of the rollers, a side of the notch opens in the direction of the corresponding segment of the cable to enable the hooking element to engage in the notch, while the other side transversely intersects the direction of the said segment so as to halt the said element when the latter travels towards the tangential zone.

The notched plate is advantageously provided with a handle enabling its rotation by the person secured, after the hooking element has engaged, so that the latter passes over the bearing section of the safety cable.

These different improvements will be better understood with the aid of the following description of several embodiments, which are given by way of example and are illustrated in the accompanying drawings.

DETAILED DESCRIPTION

Figure 1:
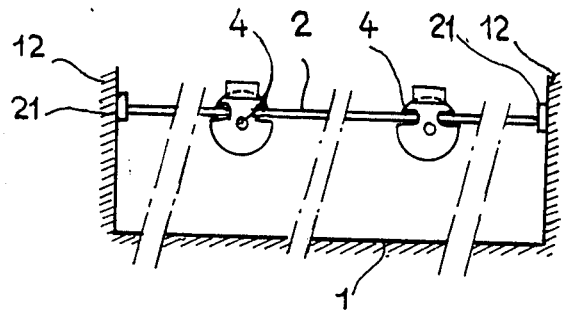
FIG. 1 shows schematically a movement path equipped with the device according to the invention.
Figure 2:
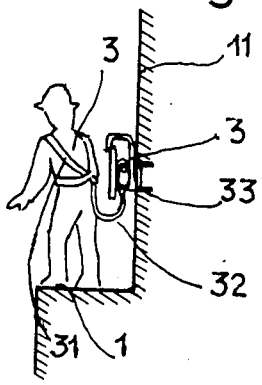
FIG. 2 is a cross-sectional view of the movement path.

FIGS. 1 and 2 show a movement path 1 which, in the example illustrated, extends along a wall 11 and which can, for example, run parallel to the path of movement of a travelling crane.

A cable 2 stretched parallel to the movement path 1, for example at a height of the order 1 to 1.5 meters is fixed by tensioning means 21 on two parts.

The secured person 3 who is moving on the movement path 1 is provided with a safety harness 31 connected by a cable 32 to a fastening ring 33 engaged on the cable 2 in such a manner as to be able to slide along the cable. The fastening ring 33 is preferably in the form of a removable snap hook, so that it can be fixed at any point on the cable 2.

The cable 2 is carried at regular intervals by regularly spaced support means 4 fastened to the fixed wall 11 or to any other fixed support, for example a guard rail, extending along the movement path.

Figure 3:
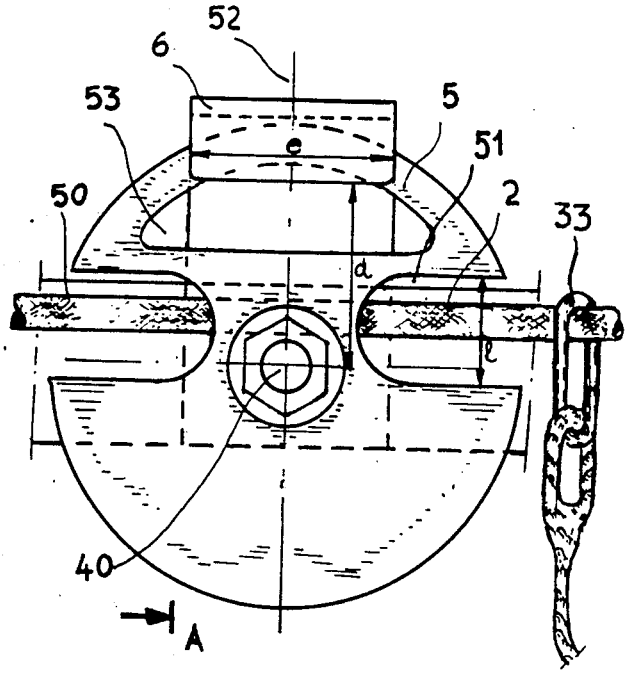
FIG. 3 is a front view of the device.
Figure 4:
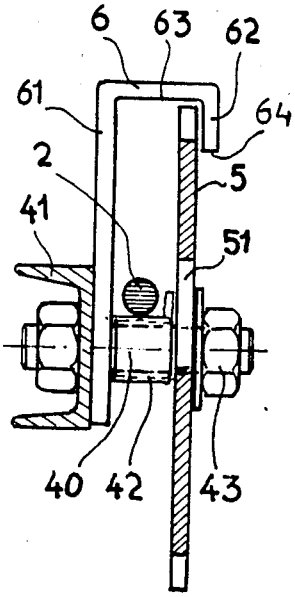
FIG. 4 is a side view in section on the line A—A in FIG. 3.

This cable support means constitutes the essential object of the invention, and one such support means is illustrated in detail in FIGS. 3 and 4.

Each support means 4 comprises an axle 40 fixed on the wall 11 on the side remote from the movement path, for example on a channel section 41 sealed in the wall 11. The axle 40 may be a simple threaded rod fixed on the section 41 by a nut and preferably carrying a ring 42. The cable 2 is simply laid on the ring 42 and retained laterally on one side by the wall 11 or the section 41 and on the other side by a disc 5 disposed at right angles to the shaft 40 and mounted for rotation about the latter, on which it is centered. The disc 5 may simply be applied against the ring 42 and fixed by a nut 43 screwed onto the end of the axle 40.

The holding plate 5 is provided with two notches 51 which have their openings in opposite directions and which are aligned along an axis 50 extending substantially at the height of the cable 2. These two notches have a width 1 slightly greater than the width of the fastening ring 33.

The plate 5 is also provided with a means returning it to the position of equilibrium shown in the figure, in which position the center line 50 of the notches is parallel to the cable. This return means may be a spring, but may more simply consist merely in disposing the center of gravity of the plate eccentrically along the axis of symmetry 52 passing between the two notches, on the opposite side to the axis 50 in relation to the axis of rotation 40. For this purpose the plate may be provided with a balancing weight placed on the opposite side to the notches, or, as is illustrated in FIG. 3, with a cutout 53 situated on the same side as the notches in relation to the axis of rotation 40, symmetrically in relation to the vertical axis 52.

When the person 3 moves along the movement path, the fastening ring 33 slides along the cable 2 and engages in one of the notches 51. Without the workman even having to concern himself in this regard, the plate 5 turns around the axis 40 and, with the fastening ring 33 still engaged in the notch 51, passes above the axle 40, the cable 2 moving slightly away from the support ring 42. When the ring 33 has passed to the other side of the axle 40, it can be released from the notch 51. The plate 5, which is thus freed, returns to its position of equilibrium through the action of the balancing weight. The same passage procedure can take place in the other direction.

In order to prevent the ring 33, carrying with it the cable 2, from escaping from the notch 51 by passing above the plate 5, it is advantageous for the top of the latter to pass inside a downwardly facing yoke 6 consisting of an inverted channel section of which one branch 61 is fixed on the wall 11 or on the section 41, while the other branch 62 simply covers the plate 5 as far as a level 64 at a distance d from the axle 40 sufficient to permit the passage of the ring 33. Similarly, the branch connecting portion 63 of the yoke 6 is placed slightly above the circular edge of the plate 5, so as not to hinder the rotation of the latter. Finally, the yoke 6 has a width e greater than the width l of the notches 51. In this way, when the plate 5 turns about the axle 40, the yoke 6 closes the notch 51 during the period in which the ring 33 would have been able to escape from the latter.

It can be seen that the device just described has the advantage that it passes above the support axles 40 without any particular intervention on the part of the person moving on the movement path 1. But above all, the hooking element may be in the form of a simple ring equipped with a detachable closure means, such as a snap hoop or a shackle, which it will be possible to attach to the cable 2 at any point; this is particularly useful, for example, for gaining access to a travelling crane in any position of its travel.

The invention has just been described in its application to movement paths at a great height, but can also be adapted to movement on a high structure of large size, for example a roof, as illustrated in FIGS. 5 to 10.

Figure 5:
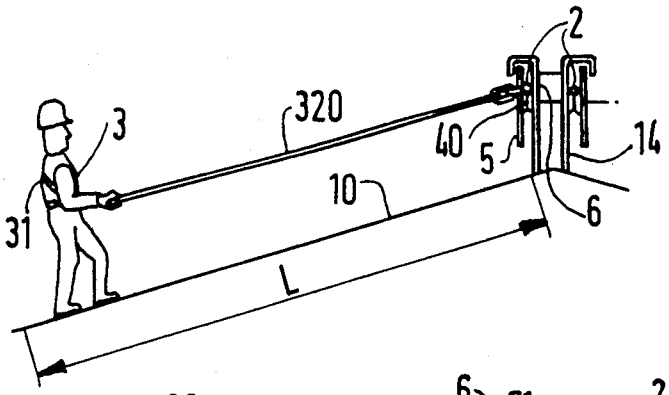
FIG. 5 is a schematic side view showing the application of the device to movement on a roof.
Figure 6:
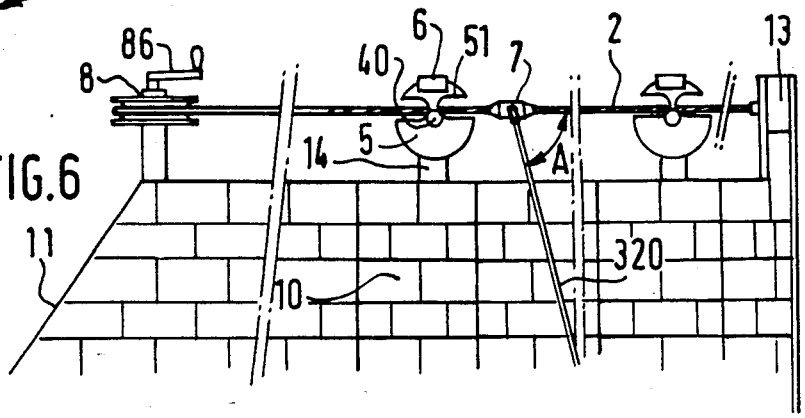
FIG. 6 is a schematic front view of the device shown in FIG. 5.

FIGS. 5 and 6 show schematically a roof 10 on which supports 13 are fixed, for example on the ridge-board, in such a manner as to stretch a cable 2 parallel to the roof and at a certain height, for example of the order of 1 meter, above the roof. The cable 2 is supported at regular intervals by intermediate supports 14, which are equipped with holding means 4 of the type previously described, i.e.) comprising a support axle 40 associated with a circular holding plate 5 provided with opposite notches 51.

Figure 7:
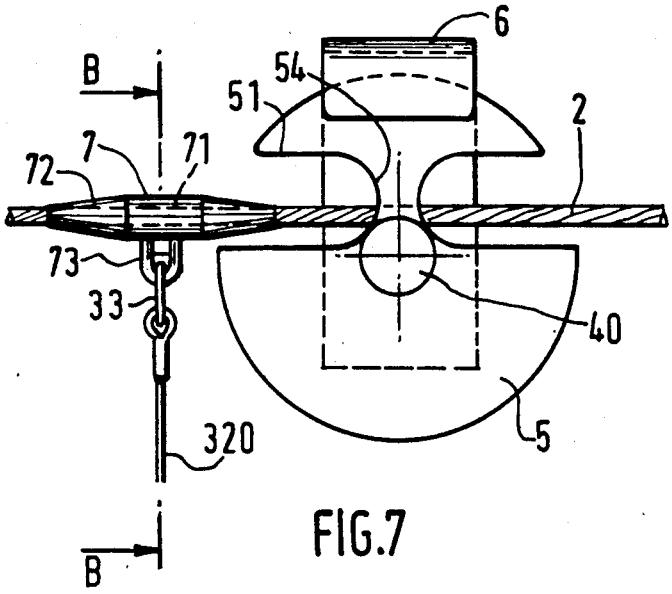
FIG. 7 is a detail view of the hooking slide as it passes a holding plate.
Figure 8:
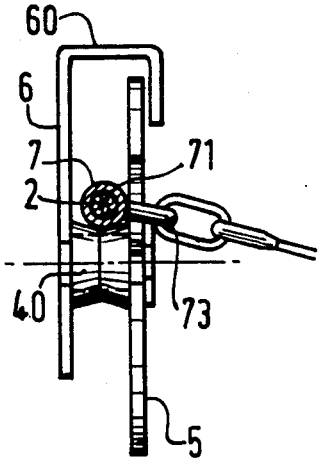
FIG. 8 is a side view in section on the line B—B in FIG. 7.

The holding device is shown in greater detail in FIGS. 7 and 8.

The cable and its support means are preferably placed on the ridge-board, as illustrated in the drawings, and in that case use will be made of two cables 2 placed symmetrically on each side of intermediate posts 14 equipped with two holding devices 4, each turned towards one side in such a manner as to permit movement on both slopes of the roof. For a very large roof it would be possible to place one cable on the ridge-board and one or more cables on the slope in such a manner as to cover the entire surface of the roof, the operator 3 being free to move along a strip of width (L) below each cable 2.

In effect the operator 3 is connected to the safety cable 2 by a tether 320 hooked to his safety harness 31, the operator being able to adjust the length of the tether, so as to be able to move at a distance (L) from the safety cable 2.

In the previous case, attachment to the cable was made by means of a simple ring, optionally a snap hook or a shackle. This arrangement is completely valid for movement at a short distance from the cable 2, since the operator can, if necessary, manually assist the passage of the hooking ring 33 over the support axle 40. This is not so in the present case, in which the operator 3 is at a distance of possibly several meters from the cable. For this reason, the hooking means comprises an elongated member 7 in the form of a tubular bush, which is provided with an internal bore 71 whose diameter is slightly larger than that of the cable 2, and which thus forms a slide adapted to slide with light friction on the cable 2. For this purpose the bore 71 may be provided with a lining of bronze or any other material facilitating the sliding, or with a ball bearing device. Furthermore, the slide 7 is provided at both ends with portions 72 having pointed profiles in such a manner as to facilitate the introduction of the slide 7 into the notches 51, and in particular to prevent jamming in the bottom 54 of the notch. The slide 7 is in addition provided with a fastening ring 73 to which the snap hook 33 can be hooked. The slide can thus be placed in a fixed position on the cable, for example in a weather proof casing disposed on the fixed support 13. The operator who is to move on the roof then simply has to hook himself to the slide 7 and move down the roof by adjusting the length of his safety tether 320. He can then move over the roof with the tether 320 forming with the direction of the cable 2 an angle A smaller than 90°. The tractive force thus determines a displacement component in the direction of the cable, and, taking into account the relatively great length of the bore 71, this is sufficient to permit the movement of the slide without the latter tending to kink.

The plate comprises two holding plates 81, 82 (FIG. 10), mounted rotatably on a fixed support 80 about an axis perpendicular to the plane of the plate 8. Between the two plates 81 and 82, there is mounted a series of rollers 83 which may each optionally rotate about an axis parallel to the axis of rotation of the plate 8, and which are each provided with a groove which corresponds to the cross-section of the cable 2, the distance between the plates 81 and 82 corresponding to the width of the hooking bush 7, the device being able to operate with or without the bush. The axes of the rollers 83 are distributed along a formed line, normally circular, centered about the axis of rotation of the plate 8.

The plate 8 is also provided with two notches 9,9′ which are diametrically opposed and which are made on the two plates 81, 82 or, in any event, at least on one of the two plates, the hooking element being located beside the latter for it to pass over the plate.

The two notches 9,9′ have a profile which is derived by rotation about the axis, in such a manner that, when the plate rotates by half a turn, each of the notches is replaced by another.

Furthermore, the two sides 91,91′ and 92,92′ of the two notches are directed in such a way that, in the direction of movement on the cable towards the plate 8, the side placed upstream enables the hooking element to engage in the notch, while the side placed downstream transversely intersects the direction of the corresponding segment of the cable 2 in such a way as to halt the travel of the hooking element on the cable.

Figure 9:
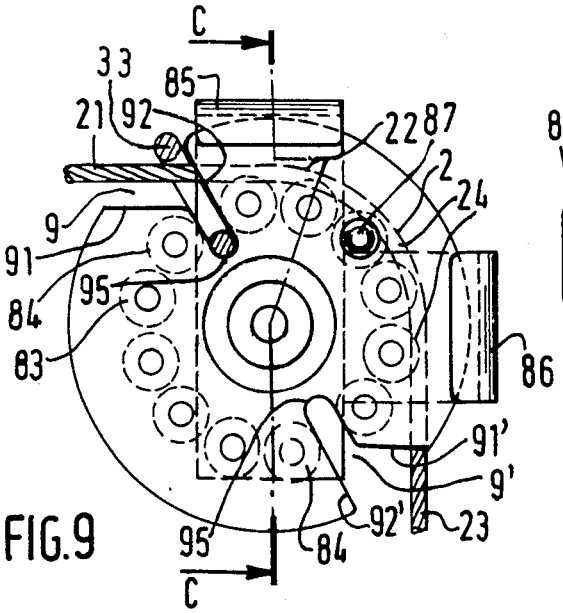
FIG. 9 is a plan view of the element for changing direction.

The rotatable plate 8 is provided so as to allow the passage of the fastening ring 33 or of the bush 7 when the latter is used. By way of example, FIG. 9 shows the passage of a ring or snap hook 33 coming from the left in the figures over the segment 21 of the cable 2. The side 91 of the notch 9 is oriented in the direction of the cable 21 so as to enable the fastening ring 33 to engage in the notch when the former travels towards the zone 22 in which it is tangential to the line of the rollers 83, while the side 92 of the notch 9, placed downstream, transversely intersects the segment 21 of the cable 2.

On the other hand, on the second notch 9′, the side 91′ transversely intersect the segment 23 of the cable 2, while the side 92′ opens towards the segment 23 so as to allow the engagement in the opposite direction of the fastening ring 33 when the latter travels towards the tangential zone 24.

Furthermore, the circular line of the rollers 83 is interrupted at the height of the two notches 9, 9′, in such a way that the bottom 95 of each of the latter penetrates between two rollers which are spaced from this purpose. In this way, when the fastening ring 33 travels, for example, on the segment 21 towards the plate 8, it engages in the notch 9, encounters the side 92 and causes the plate 8 to rotate by penetrating a notch between two rollers 84 right to the bottom 95. The depth of the notch 9 is determined in such a way that the outer edge of the ring 33 does not bear on the cable 2 during the rotation of the plate which is therefore carried out readily and without friction, the ring 33 being entrained with the rollers 83 which travel on the coiled part 24 of the cable 2. In the tangential zone 22, a fixed yoke 85 which covers the outer edge of two sections 80, 82 of the plate prevents the cable from escaping from the latter, although it is not indispensable for it to be extended over the inner section 24 of the cable between the tangential zones 21 and 23 where there is less of a risk of disengagement, the cable remaining taut over the rollers.

Continuing its rotation, the ring 33 then arrives in the tangential zone 24 which is also covered by a fixed yoke 86, and continues to travel on the segment 23 of the cable.

The rotation of the plate 8 may advantageously be aided by the operator, by means of a handle 86 which is optionally fixed directly on the plate 8 so that it can move or, alternatively, mounted on a crank, as is shown in FIG. 6.

At the end of the rotation, the notch 9 has taken the place of the notch 9' and the side 91 has taken the place of the side 91'. It is therefore oriented in such a way that, in this position, it crosses the segment 23.

When the ring 33 travels in the other direction on the segment 23, it thus encounters the side 91' and controls the rotation of the plate 8 as it approaches the tangential zone 24. During this rotation, the ring, which is enclosed by the rotation of the side 92' of the notch 9', is engaged in the latter between the rollers 84' right to the bottom. In the same way as before, the yoke 86 prevents the cable from becoming disengaged from the plate in the tangential zone 24.

The operation of the plate which has just been described, in the case where a simple fastening ring 33 is used, would be similar for the passage of a bush 7. It would then be necessary for the two rollers 84 on either side of each notch 9 to be set at a distance which is substantially equal to the length of the bush 7 in order that the latter is inserted between them in such a manner as to be able to slide effortlessly on the cable 2 during the rotation of the plate 8.

When it is necessary for the operator to pass over another segment of the safety cable 2, he climbs up to the support 8, engages the fastening ring 33 or the bush 7 in the notch on the plate 8, controls the rotation of the latter by means of the handle 86 and can then climb back down on the other side of 11 of the roof.

Figure 10:
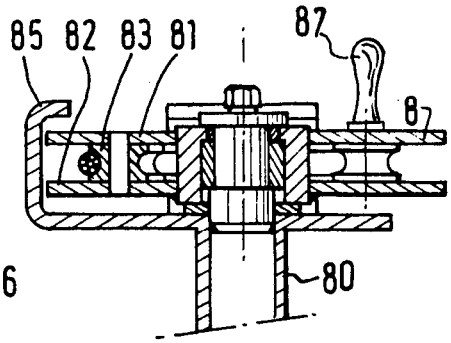
FIG. 10 is a sectional view on the line C—C in FIG. 9.

In the embodiment shown in FIG. 10, the yokes 85 are fixed on the support 80 below the plate 8 and the operator must therefore pass the fastening ring or the bush 7 with the tether 320 over the upper face of the plate which alone must be provided with notches. However, the yokes could also be fixed in the axle of the plate 8, above the latter, and in this case, the operator would have to pass the hooking element below the plate. In this circumstance, the lower plate 82 would have to be provided with notches 9 and 9'.

In this latter arrangement, it would not always be necessary for the operator 3 to climb up the ridgeboard at the height of the support 8, since the passage of the hooking element on the plate 8 can optionally be carried out from a distance, under the action of the tether 320.

It can be seen that, owing to the invention, the operator possesses great freedom of movement, and for this reason, the invention can also be used, in a general way, to secure the movement of a person, optionally in several directions, on a structure at a great height, without being constrained to follow a determined path at a short distance of the safety cable.

Figure 11:
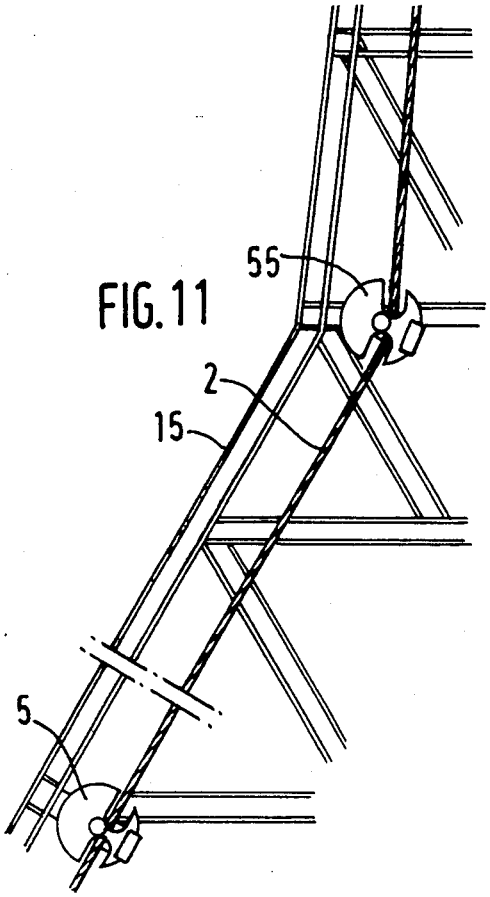
FIG. 11 is schematic view of the device applied to movement in a trellis structure.

However, the safety cable can also follow any direction and, by way of example, a pylon 15 is shown in FIG. 11, the said pylon being of a metal trellis construction and provided with a safety cable 2 which follows the general vertical direction of the pylon and optionally with transverse arms 16 extending in a horizontal or inclined direction. Pylons such as these are not generally provided with a ladder surrounded by a tubular safety corridor which enables them to be climbed without danger and, in any event, the person moving on this structure must in some cases have a certain freedom of movement, for example to paint it, or alternatively to gain access to certain parts which are too narrow for the positioning of fixed safety corridors, for example in the arms 16.

FIG. 11 demonstrates how easy it is to stretch an optionally vertical cable 2 along the pylon with the positioning of intermediate supports 5 at regular intervals in order to support it. Some of these supports, such as 55, can be located in corners to facilitate small changes in direction of the cable, the notches being oriented in the direction of the two segments. Obviously, since the cable 2 is not horizontal, the plate 5 must be brought back, after rotation, in the direction of the cable, by a resilient return member.

If the change of direction is too sharp, for example in order to penetrate an arm 16, the plate 8 described above can be used, the latter being capable of being positioned in any direction whatsoever.

Figure 12:
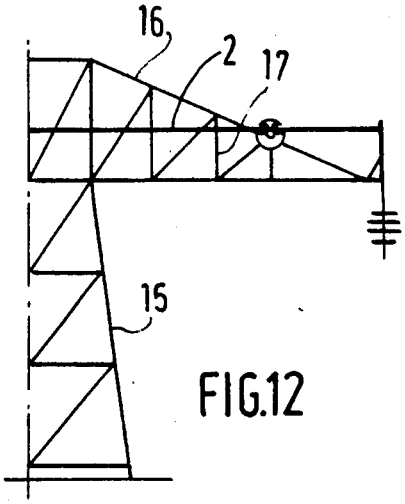
FIG. 12 is a schematic view of the application of the device to a pylon.

FIG. 12 shows an example of application to an electric pylon which makes it possible, by means of a horizontal cable 2, to move either within the metal structure, or on the outside of the latter, when the passage section becomes too narrow, since the cable is capable of passing between the struts 17 of the trellis structure. It can been seen that, by virtue of the use of a device according to the invention, the operator connected to the safety cable by a tether of a suitable length can gain access to any point on the pylon.

A similar arrangement could be used, for example, to secure the safety of a person who has to move along a horizontal or inclined crane jib, the invention having a general application each time it is necessary to move on a structure at a great height while retaining some freedom of movement.

I claim:

1. A device for securing the safety of a person moving on a structure at a great height, comprising a cable (2) or other elongated element forming a railing, extending along a direction of movement (1) and carried by a plurality of spaced support means (4), and a hooking element in the form of a ring (33) adapted to slide along said cable, wherein each support means (4) consists of a substantially horizontal axle extending at right angles to said cable (2) and fixed at one end, on the side remote from said movement path (1), on a fixed part (41), while at its other end, on the side of said movement path (1), it carries a plate (5) holding said cable (2), lying at right angles to the axle (40) and mounted for rotation on the latter, said cable (12) being simply laid on each support axle (40) and retained on one side by said fixed part (41) and on the other side by said holding plate (5), said holding plate being provided with two aligned notches (51) for the passage of said hooking ring (3) in one direction or the other, said notches opening toward the outside in opposite directions and having a sufficient width for the hooking ring (33) to engage therein by sliding on said cable (2) and to pass above said support axle (40) through rotation of said holding plate, said holding plates associated with the two notches (51) being aligned with said cable (2), each in one direction.

2. A safety device as claimed in claim 1, wherein each support axle (40) is associated with a fixed downwardly facing yoke adapted to extend over said holding plate (5) and to close said notch (51) when said plate passes above said axle (40).

3. A safety device as claimed in claim 2, wherein said closure yoke (6) is in the form of a U-shaped member centered in a vertical plane of symmetry passing through said axle and having a width (e) greater than that (1) of said notches (51), said member covering a top part of said holding plate (5) as far as a level (64) at a distance (d) from said axle (40) permitting passage of said hooking element (33).

4. A safety device as claimed in claim 1, wherein the means returning the plate to the position of rest comprises the eccentric arrangement of the center of gravity of said plate along the axis of symmetry passing between said two notches.

5. A safety device as claimed in claim 1, wherein the person secured (3) is connected to said hooking element (7) by means of a tether (320) which is of sufficient length to give it a certain freedom of travel in every direction on said structure (1), and wherein said hooking element consists of an elongated bush (7), provided with an internal bore (71) of a diameter substantially equal to that of said cable (2) and capable of sliding with light friction on said cable under the action of a tractive force exerted at a distance on said tether by the person secured.

6. A safety device as claimed in claim 5, wherein said elongated bush (7) is permanently mounted in said cable (2) and wherein said tether (320) is hooked on said bush (7) by means of an attaching element (33) which is removable in the manner of a snap hook or a shackle.

7. A safety device as claimed in claim 5, wherein said bush (7) is provided with shaped portions (72) at its two ends which enable it to be introduced into said notches (51) of said holding plate (5) without risk of blockage.

8. A safety device as claimed in claim 5, applied to movement on a roof (10), said safety cable (12) being stretched between two fixed points (13) parallel to said roof (40).

9. A safety device as claimed in claim 5, applied to movement on a metal trellis structure such as a pylon (12) or scaffolding, said safety cable (2) being stretched in a preferred direction of movement along said structure (12).

10. A safety device as claimed in claim 1, wherein said cable (2) passes over the intermediate support elements (8) determining a change of direction and each comprising two holding plates (81, 82) set at a distance from each other, at least one of said holding plates being mounted rotatably about a transverse axis, and a series of rollers (83) placed between said plates (81,82) and arranged in a circular line around said axis of rotation, said cable (2) coiling around an angular section of said circular line by bearing on corresponding rollers (83), and said rotatable plate (81) being provided with at least two notches (9) the shape of which is determined so as to allow said hooking element (7) to be introduced with rotation of said plate (81) in either direction of travel on said cable (2), said notches (9) being positioned on said plate in such a way that a notch (9) is positioned on the passage of said hooking element (33) (7) in each direction of travel and that the notch in which said bush is engaged is replaced by another notch after rotation over the necessary angle for the passage of said hooking element (33) (7).

11. A safety device as claimed in claim 10, wherein said rotatable plate (8) is provided with two notches (9) which are diametrically opposed, whose shapes are derived from one another by rotation of 180° and which have two sides (91, 92) oriented in such a manner that, in each zone (22) in which said cable is tangential to the line of said rollers, a side (91) of said notch opens in the direction of the corresponding segment (21) of said cable (2) to enable said hooking element (33) (7) to engage in said notch, while the other side (92) transversely intersects the direction of said segment (21) so as to step said hooking element (33) (7) when the latter travels towards said tangential zone (22).

12. A safety device as claimed in claim 10, wherein said notched plate (8) is provided with a handle (86) enabling its rotation by the person secured (13), after said hooking element (7) has engaged, so that the latter passes over the bearing section of said safety cable (2) on said plate (8).

13. A safety device as claimed in claim 1, applied to movement on a metal trellis structure (15) such as a pylon, said safety cable (2) being stretched in the general direction of said structure (15) and/or of transverse arms (16) thereon.

14. A safety device as claimed in claim 13, wherein, in narrow parts of said structure (16), said safety cable (2) is extended to the outside of the latter, passing between struts (17) of said metal trellis.

15. A device for securing the safety of a person moving on a structure at a great height, comprising a cable (2) or other elongated element forming a railing, extending along a path of movement (1) and carried by a plurality of spaced support means (4), wherein:

(a) each support means (4) consists of a substantially horizontal axle (40) at right angles to said cable (2);

(b) said axle (40) is fixed at one end, on the side remote from said movement path (1), on a fixed part (41), while at its other end, on the movement path (1) side, it carries a plate (5) holding said cable (2);

(c) said plate(5) extending at right angles to said axle (40) and being mounted for rotation on the latter;

(d) said cable (2) being simply laid on each support axle and retained on one side by said fixed part (41) and on the other side by said holding plate (5);

(e) said plate (5) being provided with two aligned notches (51) open towards the outside in opposite directions, said notches (51) having a sufficient width for a hooking ring (33) to engage in it by sliding on said cable (2) and to pass above said support axle (40) through the rotation of said holding plate;

(f) said holding plate being associated with a means returning it to a position of rest in which the two notches are in line with said cable (2), each in one direction; and (g) said support axle (40) being associated with a fixed downwardly facing yoke adapted to extend over said holding plate (5) and to close said notch (51) when said plate passes above said axle (40).

* * * * *